US008007300B2

(12) United States Patent
Vogt et al.

(10) Patent No.: US 8,007,300 B2
(45) Date of Patent: Aug. 30, 2011

(54) LAMP HOLDER

(75) Inventors: Karl-Wilhelm Vogt, Ense (DE); Hartmut Greschner, Arnsberg (DE); Markus Nasse, Hamm (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 12/689,668

(22) Filed: Jan. 19, 2010

(65) Prior Publication Data

US 2010/0120279 A1 May 13, 2010

Related U.S. Application Data

(63) Continuation of application No. 12/191,806, filed on Aug. 14, 2008, now Pat. No. 7,736,163.

(30) Foreign Application Priority Data

Oct. 25, 2007 (DE) ..... 10 2007 051 431
Nov. 17, 2007 (DE) ..... 10 2007 054 930

(51) Int. Cl.
*H01R 33/08* (2006.01)

(52) U.S. Cl. ..... 439/239

(58) Field of Classification Search ..... 439/239, 439/226, 666, 241, 234, 231; 362/221
See application file for complete search history.

(56) References Cited

U.S. PATENT DOCUMENTS 7,568,930 B2 * 8/2009 Brand et al. ..... 439/234
2007/0066112 A1 * 3/2007 Tufano et al. ..... 439/239
* cited by examiner

*Primary Examiner* — Alexander Gilman
(74) *Attorney, Agent, or Firm* — Andrew Wilford

(57) ABSTRACT

A bipin fluorescent-lamp holder has a housing formed with an outwardly open housing mouth and a rotor rotatable in the housing adjacent the mouth about an axis and having a diametrally throughgoing rotor slot. The rotor is rotatable between an installation position with the rotor slot aligned with the slot and an angularly offset contact position with the slot not aligned with the mouth. The rotor and housing are so dimensioned as to receive the pins extending parallel to the axis and to move the pins in a circular orbit centered on the axis on rotation of the rotor in the housing, and contacts in the housing diametrally flanking the axis each having a main part lying outside the orbit and a contact part engageable into the orbit. The contacts pins are aligned with the slot and project into ends of the slot and into engagement with the pins only in the contact position of the rotor.

11 Claims, 10 Drawing Sheets

LAMP HOLDER

CROSS REFERENCE TO RELATED APPLICATION

This application is a continuation of U.S. patent application Ser. No. 12/191,806 filed 14 Aug. 2008 with a claim to the priority of German patent applications 10 2007 051 431.1 and 10 2007 054 930.1 respectively filed 25 Oct., and 17 Nov. 2007.

FIELD OF THE INVENTION

The present invention relates to a lamp holder. More particularly this invention concerns a holder for a two-pin fluorescent lamp.

BACKGROUND OF THE INVENTION

A typical light fixture for a bipin-base fluorescent lamp has a pair of lamp holders between which the lamp fits. Each holder has a housing with a mouth and a rotor rotatably supported in the housing adjacent the mouth and having an installation slot for receiving contact pins of the fluorescent lamp and, when the mouth is brought into alignment, for defining a lamp installation position. The rotor guides the lamp pins when the lamp is rotated in the holder along a circular orbit into a contact position for making contact with holder contacts supported in the housing. The rotor assumes in the contact position an engagement position that at least partially impedes rotation.

Lamp holders of the above-described type usually serve for the electrical connection of fluorescent lamps with a socket on both ends—especially fluorescent tubes with G13 sockets—that comprise two lamp pins on their holder side and extend parallel to the longitudinal axis of the lamp. The housing as well as the rotor each have a mouth and an installation slot that, when brought into alignment, make it possible to install the lamp in the holder. In the installed state the lamp pins are recessed in the rotor.

For making electrical contact with holder contacts provided in the housing and usually designed as spring contacts, the lamp is rotated to entrain the rotor, during which a 90° rotation is usually required in order to reach the contact position.

In order to make the contact position recognizable for the user and to ensure that the lamp remains in this contact position, the rotor comprises at least one engagement position. German Utility Model 1 915 204 discloses for example an engagement plate provided underneath the rotor whose engagement cams directed to the rotor engage recesses on the rotor. GB 591676, on the other hand, shows a spring contact opened in an approximate V-shape toward the rotor center and in which the lamp pins are gripped after the rotor has been rotated through 90°—starting from the installation position. JP 2002-100450 shows a similar solution for making the contact position recognizable.

Further generic publications showing corresponding holders with at least one contact position made recognizable by engagement or catching are, e.g. CH 266505, GB 581097 or German Utility Model 6914559. Holders with intermediate engagement positions are also known from the prior art.

Even if the possibilities for making the contact position of the fluorescent lamp in the holder recognizable consistently fulfill its function, a plurality of which are known from the state of the art, they have disadvantages.

The lamp replacement is not only carried out by trained personnel but usually by users that are not informed in detail about the technical design of such a lamp holder. Since fluorescent lamps become at least moderately warm in operation and illumination systems can frequently not be completely turned off, the replacement of a defective lamp frequently takes place under applied voltage. As a consequence, the replacement lamp lights up as soon as the lamp pins contact the holder contacts for the first time. In the case of the prior-art holders the contact between lamp pins and holder contacts usually takes place far before reaching the contact position in which a reliable seating of the lamp in the holder and a contact, e.g. with good contact pressure between the contacts on the holder and the contact pins on the socket, are assured. Due to a lack of is knowledge of the user, the fluorescent lamps remain loose since lighting of the lamp allows an orderly function to be assumed.

However, it has turned out that an orderly function is not given in a loose position. Vibrations, jolts or changes in position of the lamp pins due to temperature fluctuations can result in the fluorescent lamp and the non-engaged rotor readily moving, so that contact between the lamp and the holder is intermittently or completely interrupted. As a result, the lamps are considered to be faulty or defective or an unpleasant flickering occurs due to uncontrolled intermittent contact and the associated repetitive ignitions of the lamp, which for its part strains the so-called starter of the lamp and/or the operating apparatus and results in premature aging. Even damage to the holder contacts and/or lamp pins by arcing is possible. In a few cases the misaligned rotor can also rotate again into its installation position so that the installation slot of the housing and of the rotor are then in alignment. In the worst case the lamp then becomes detached from the holder and falls out.

OBJECTS OF THE INVENTION

It is therefore an object of the present invention to provide an improved fluorescent-lamp holder.

Another object is the provision of such an improved fluorescent-lamp holder that overcomes the above-given disadvantages, in particular that ensures that the fluorescent lamp is fully rotated into the contact position.

SUMMARY OF THE INVENTION

This object is attained in a lamp holder having a housing formed with an outwardly open housing mouth and a rotor rotatable in the housing adjacent the mouth about an axis and having a diametrally throughgoing rotor slot. The rotor is rotatable between an installation position with the rotor slot aligned with the slot and an angularly offset contact position with the slot not aligned with the mouth. The rotor and housing are so dimensioned as to receive the pins extending parallel to the axis and to move the pins in a circular orbit centered on the axis on rotation of the rotor in the housing, and contacts in the housing diametrally flanking the axis each having a main part lying outside the orbit and a contact part engageable into the orbit. The contacts pins are aligned with the slot and project into ends of the slot and into engagement with the pins only in the contact position of the rotor.

Furthermore according to the invention each contact comprises a spring arm with the contact part projecting radially inward toward acing the rotor center and serving to make contact with each socket contact pin of the lamp in the contact position and otherwise is formed in such a manner that other areas of the holder than the contact part are out of contact with the lamp pins in other positions of the rotor.

In contrast to the state of the art, where the contacts are usually arcuate or V-shaped, that is designed in such a manner that the lamp pins of the lamp rest in a wide range of the partial circular arc that they describe by the rotating of lamp and rotor until a contact position is reached on the contacts in a functionally unreliable manner, such a system is avoided in accordance with the invention. The user will rotate the lamp into the contact position by means of the contact parts facing the rotor center that can be brought into engagement only when rotating into the contact position with the lamp pins on the lamp.

In a preferred embodiment the spring arm has a portion directed substantially conically or in a circular arc to the rotor center.

For the largest possible contact part and a reliable hold of the fluorescent lamp in the contact position the contact part has a contact edge at its apex with a flattened area or recessed area for fitting complementarily with the respective socket contact pin.

Since the position of the lamp pins of both lamp sockets to one another, the distance of the lamp pins to one another at each socket as well as the diameter of the lamp pins themselves can vary somewhat, a further feature of the invention is that each contact part forms at its apex a contact edge adapted in its shape to a width of the rotor-side installation slot so that it can penetrate at least partially into the installation slot in order to compensate for tolerances of the lamp pins. To this end it has an angular dimension smaller than the slot width.

An especially preferred embodiment is characterized in that the rotor comprises control projections that are provided on its outer surface and have control surfaces that cooperate with spring elements that are provided on the housing and that force the rotor into the contact position after passing a dead center reached by rotation and while building up spring tension. In this embodiment of the invention faulty starting of the fluorescent lamp is practically excluded since electrical contact comes about exclusively in the contact position and also the rotor is forced into the contact position by virtue of its control surfaces.

For simplified manufacture of the holder, the spring element is a leaf spring formed by the contact, and in particular that spring arm is formed as a leaf spring acting on the rotor.

The spring force of the spring arm, which forces the rotor into its contact position as well as serves for making contact with the lamp pins, can be increased in that the contact also forms a spring support arm and in that the free ends of the spring arm and the support arm overlap each other in a supporting manner.

Finally, the contact part of the spring arm facing the rotor center forms a control cam and cooperates with the control surfaces of the rotor in such a manner that the spring arm designed as a leaf spring is spread when the rotor rotates, building up spring tension until reaching the dead center and forces the rotor into the contact position when the spring tension is relaxed. It is advantageous if the contact edge forms the control cam.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
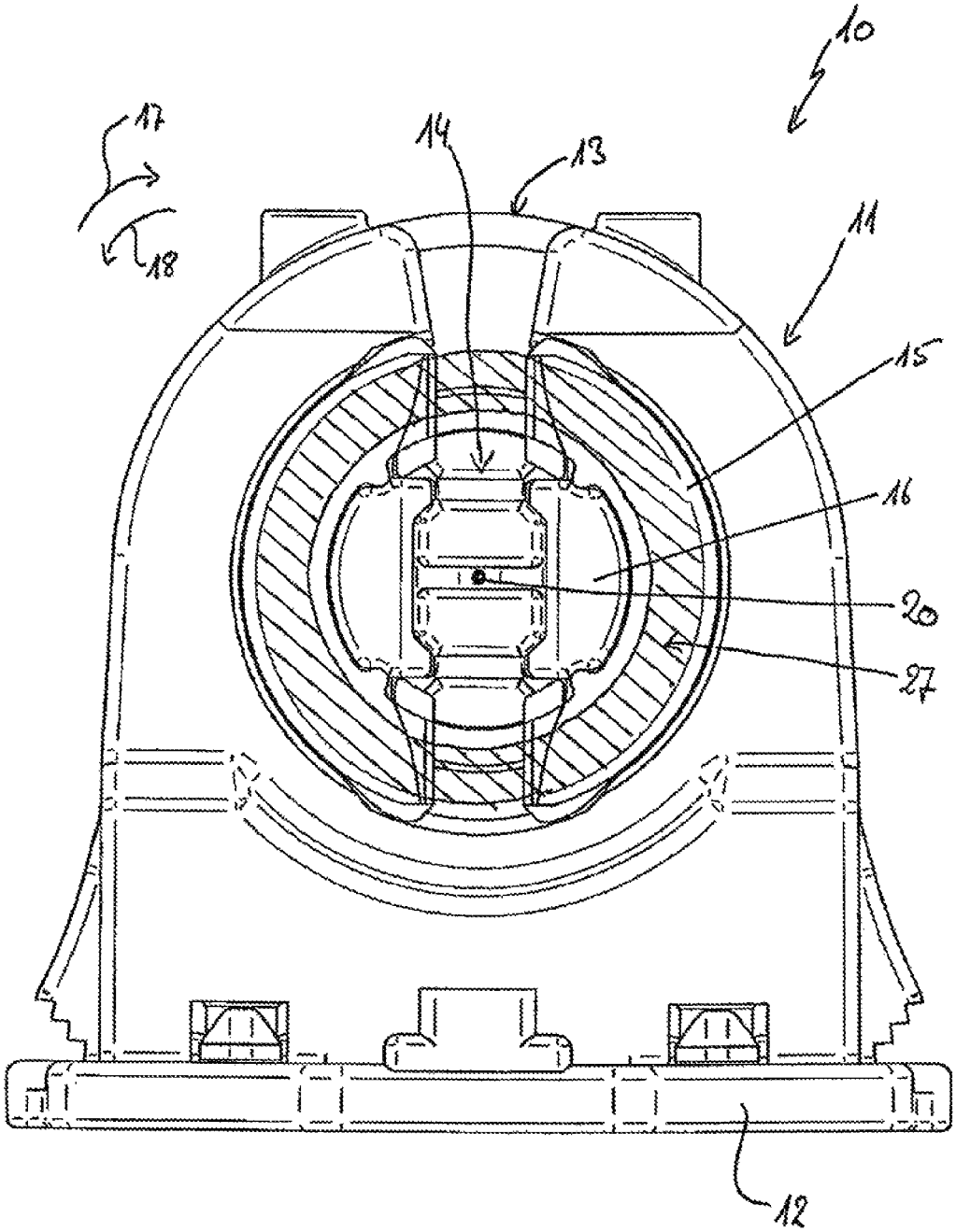
FIG. 1 is an elevational side view of a lamp holder in the lamp installation position.

As seen in FIG. 1 a lamp holder 10 comprises a dielectric housing 11 with a plastic base 12 that serves to mount the lamp holder 10, e.g. in a light fixture. The housing 12 has a slot-shaped mouth 1 opposite the base 12, also designated as an installation slot 13 that opens in the installation position shown in FIG. 1 into an installation slot 14 of a rotor 15 rotatably supported in the housing 11. The rotor 15 itself is supported in a cup-shaped part of the housing and is nondetachably fixed in the housing 11 by retaining tabs 16.

Figure 2:
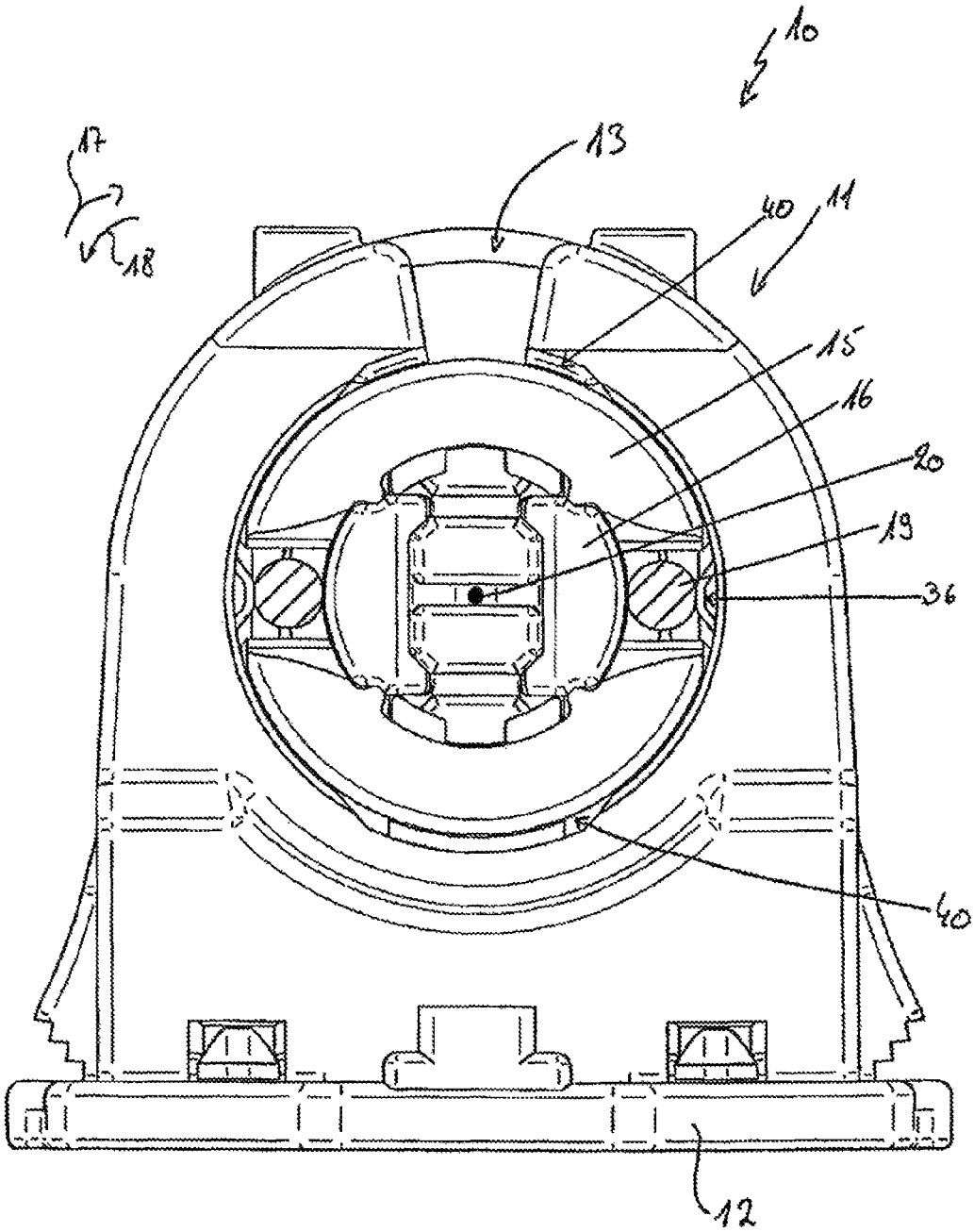
FIG. 2 is a view of a lamp holder in a contact position.

FIG. 2 shows the lamp holder 10 with the rotor 15 rotated into the contact position. Contact pins 19 only shown in section engage on contact parts 26 of the socket contacts 22 shown in FIG. 3. To this end the rotor 15 is 90° offset in the contact position from the installation position.

Figure 3:
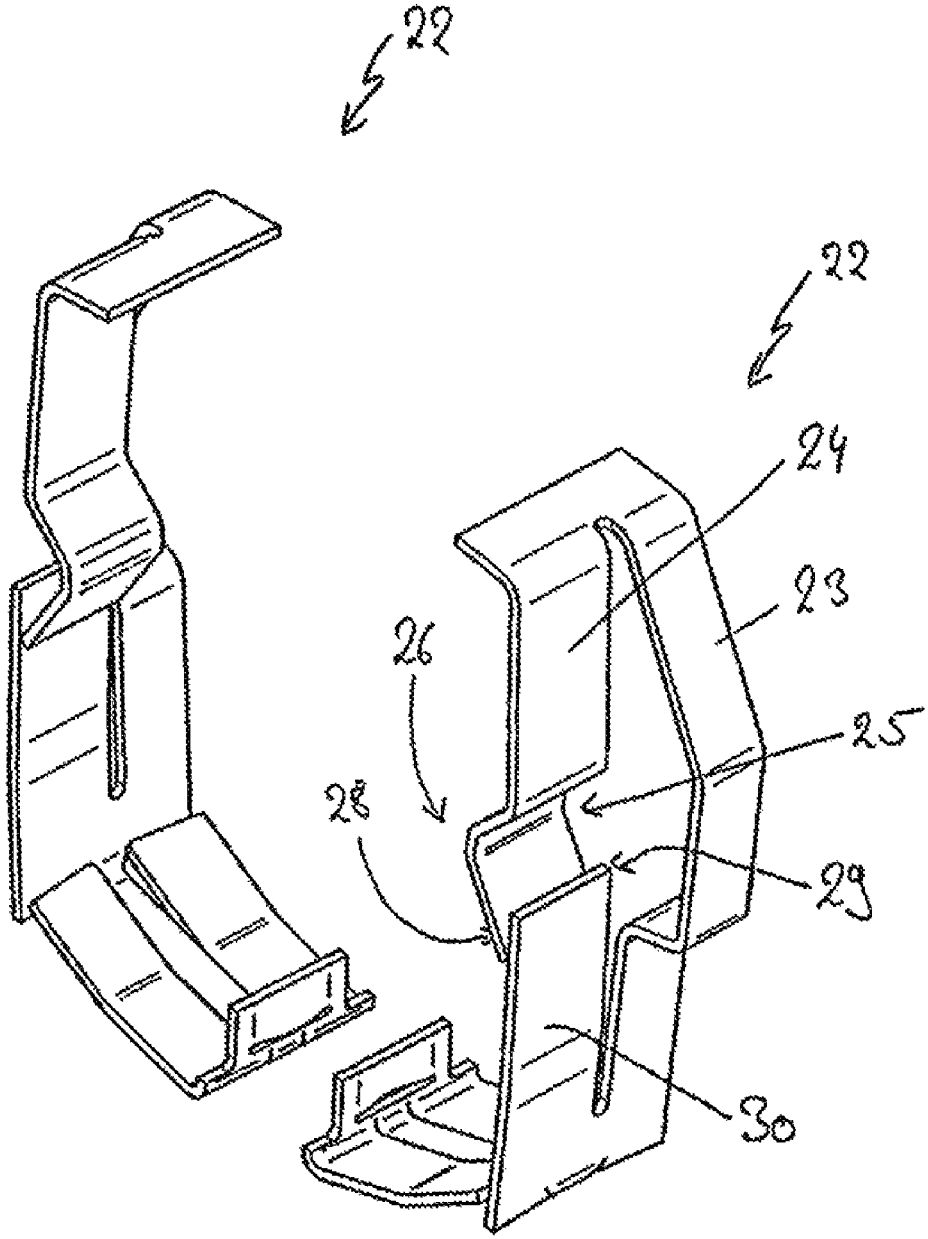
FIG. 3 is a view of the contacts provided inside the housing.
Figure 10:
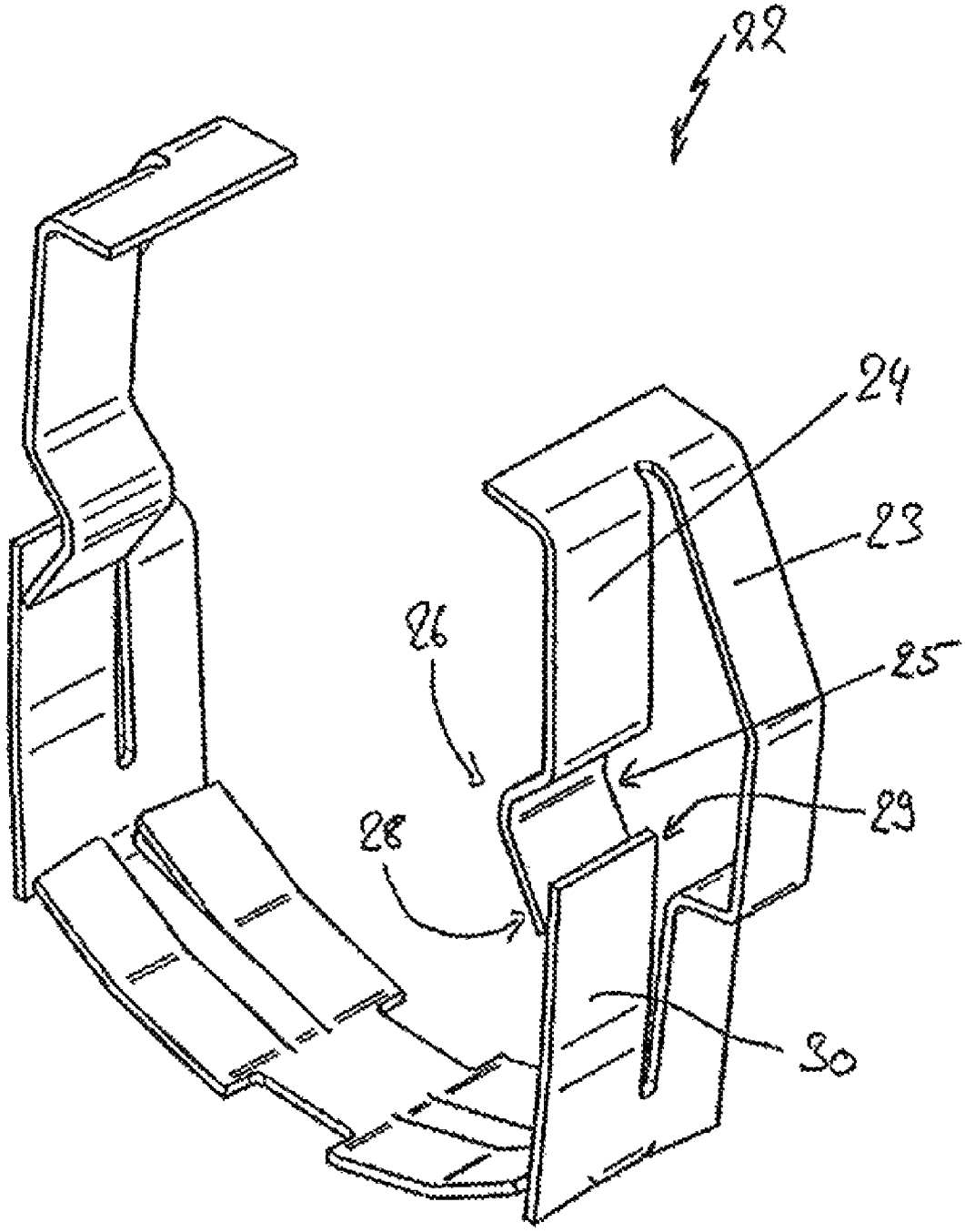
FIG. 10 is a view of alternative contacts.

FIG. 3 shows the contacts 22 that are mounted inside the housing 11, here in a two-part design for so-called rapid-start variants. A one-part design of contacts 22 for so-called instant-start variants is shown in FIG. 10. The following description also applies—aside from the two-part design of the contacts shown in FIG. 3—identically to FIG. 10.

The contacts 22 are stamped from sheet metal and are positioned mirror symmetrically relative to each other inside the housing 11. Each contact 22 has a one-piece main part or retaining leg 23 that fits with the inner surface of the housing 11 and that serves to retain the contact 22 in the housing 11. The retaining leg 23 engages the inner surface of the housing at several locations, namely at its end and at its center. It is important that the retaining legs 23 be located far outside the orbit 27 (FIG. 1) of the lamp pins 19 of a fluorescent lamp that are guided by the rotor 15.

The contact legs of the socket contact 22 are each formed of two parts, namely a spring arm 24 and a support arm 30. The spring arm 24 comprising a V-shaped portion 25 directed toward the rotor axis 20 (not shown) forms the respective contact part 26. The contact part 26, which is flattened at its apex, is the only portion of the spring arm 24 that projects into an orbit 27 (shown by hatching in FIG. 1) extends as a circle and is pressed against the lamp pins 19 by the rotor 15. Therefore, only this relatively small contact part 26 makes possible an electrical connection between the lamp pins 19 and the contacts 22.

The spring arm 24 is designed as a leaf spring connected on one side to the retaining leg 23 whose free end 28 carrying the leaf spring overlaps a free end 29 of a springy elastic support arm 30. The support arm 30, which is designed in a springy elastic manner, makes it possible to apply greater spring return forces to the spring arm 24.

Figure 4:
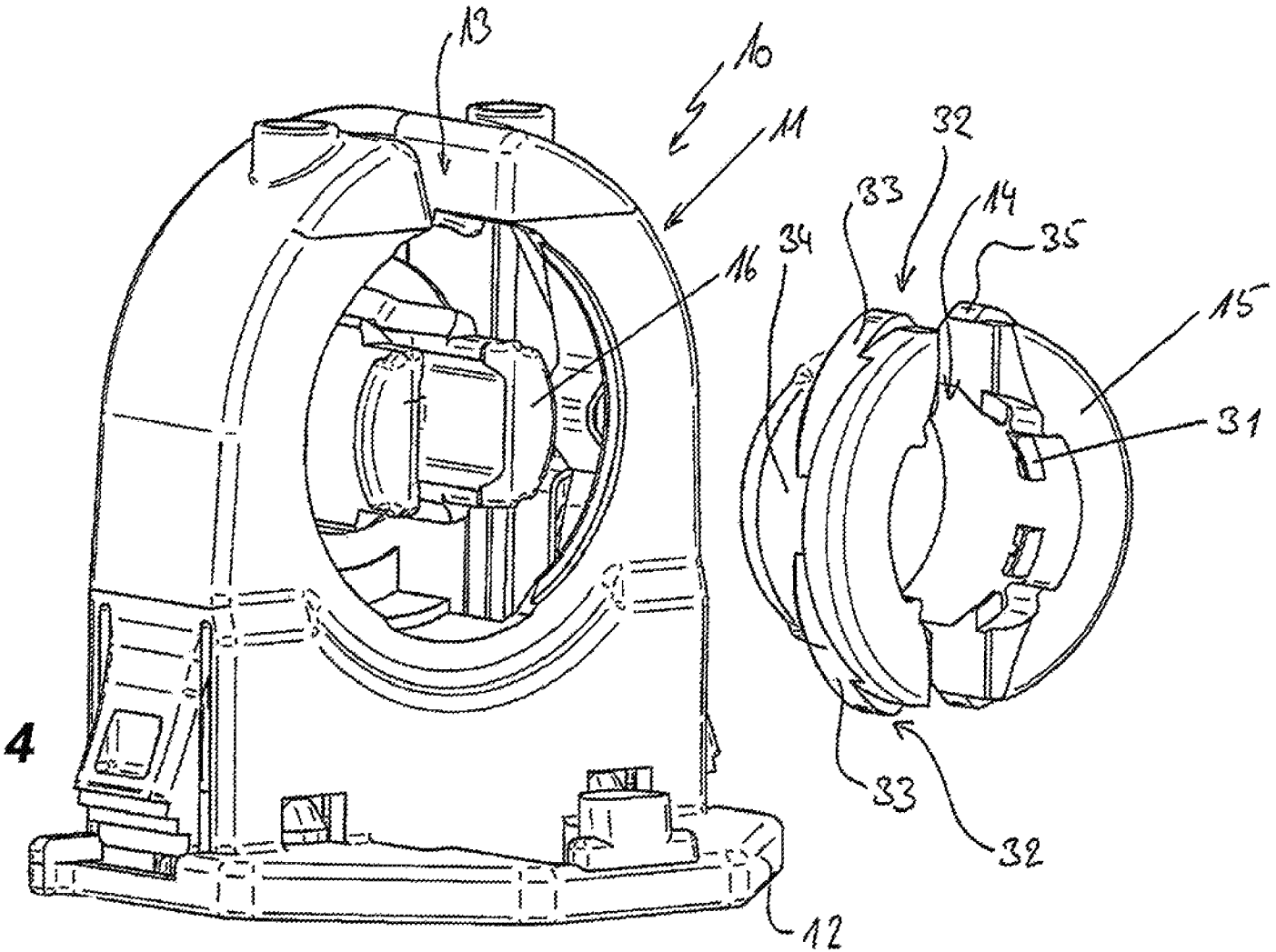
FIG. 4 is a lamp holder according to FIGS. 1 and 2 in an exploded view.

FIG. 4 shows the housing 11 once more but in an exploded view. The rotor 15 is shown here separated from the lamp holder 10. In addition to engagement projections 31 that are provided inside the rotor 15 and over which the retaining tabs 16 extend for a nondetachable retention of the rotor 15 in housing 11, wing-like projections 32 are shown that form cooperating control surfaces 33 with the portions 25 of the spring arms 24. Whereas the outer surface of a rotor shaft 34 located inside the housing when the rotor 15 is installed is substantially circular, projections 32 extend outward from the outer surface of the rotor shaft 34 in areas to an approximate oval, and control formations 33 in the installation slot 14 are designed as sliding surfaces 35 inclined radially inward toward a rotor center 20. The projections 32 thus immediately flank the installation slot 14.

The operation of lamp holder 10 is described in the following using FIGS. 5 to 8:

FIGS. 5 to 8 each show a longitudinal section through the housing 11 of the lamp holder 10 according to FIG. 1 and the position of the rotor 15 differs in the individual figures.

Figure 5:
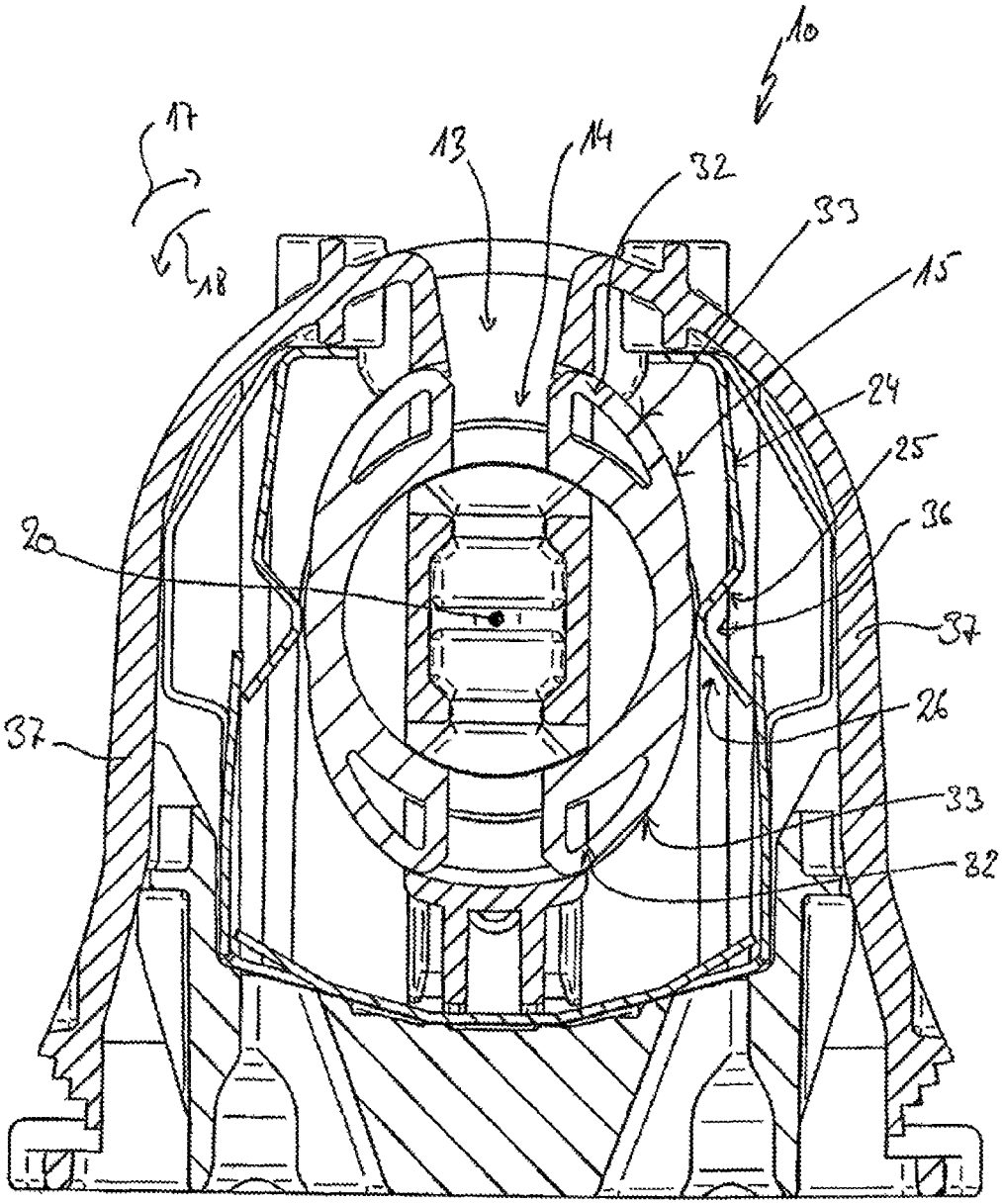
FIG. 5 is a longitudinal section through the lamp holder according to FIG. 1 in the installation position.

In FIG. 5 the rotor position corresponds to that of FIG. 1. The rotor 15 is located in the so-called installation position. In the installation position the mouth 13 of the housing 11 and installation slot 14 or rotor 15 are aligned so that the lamp pins 19 (not shown here) can be pushed into the lamp holder 10 and engage through the rotor 15.

Figure 6:
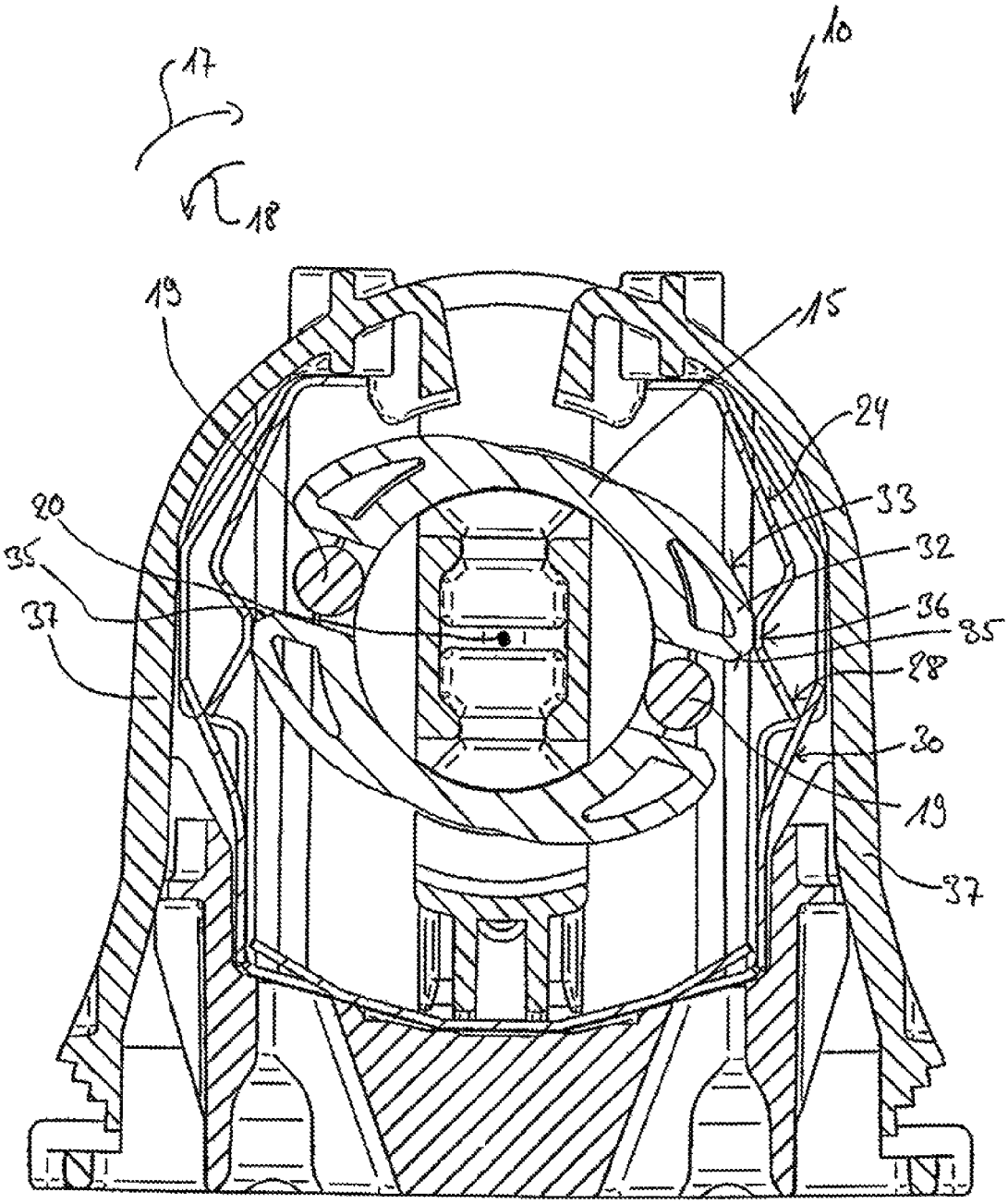
FIG. 6 is a longitudinal section according to FIG. 5 with the rotor in the dead-center position.
Figure 7:
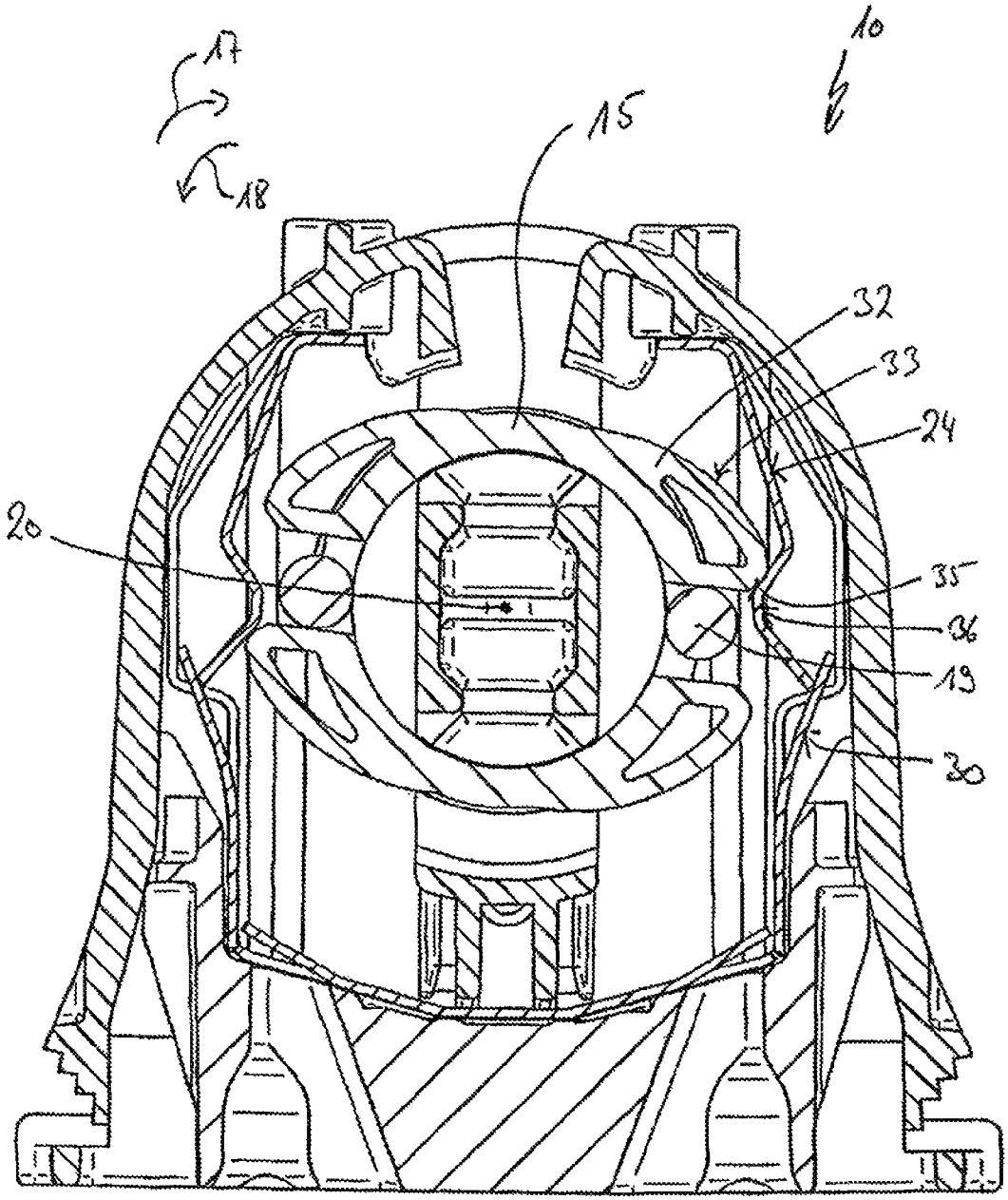
FIG. 7 is a longitudinal section according to FIG. 5 with the rotor past the dead-center position.

The end portions 25 of the spring arm 24 that forms the contact parts 26 lie outside the outer surface of the rotor 15. Conically tapering contact edges 36, which here form the contact parts 26, also fulfill a control function as control cams in addition to the contact function. When the lamp is rotated in a direction of rotation 17 or 18, contact parts/edges 26/36 slide over the control surfaces 33 of the control projections 32 and displace the spring arms out of their rest positions toward a housing wall 37 as shown in FIG. 6. The free end 28 of the spring arm 24 is supported here on the support arm 30 which is also deformed as a result out of its rest position toward the housing wall 37. Thus, spring return forces are applied to the arms 24 and 30, manufactured from a springy elastic material, of the contact 22 that displace the arms 24 and 30 back toward the rotor center 20.

In FIG. 6 the arm 24 is maximally deflected outward and the rotor is located in a so-called dead-center position. A slight further rotation results in engagement of the contact edges 36 with the sliding surfaces 35 of the control projections 32. Consequently, the contact edges slide into the installation slot 14 (shown in FIG. 7) and force the rotor 15 to complete the 90° rotation (see FIG. 7) and to move into the contact position (see FIG. 8).

Figure 8:
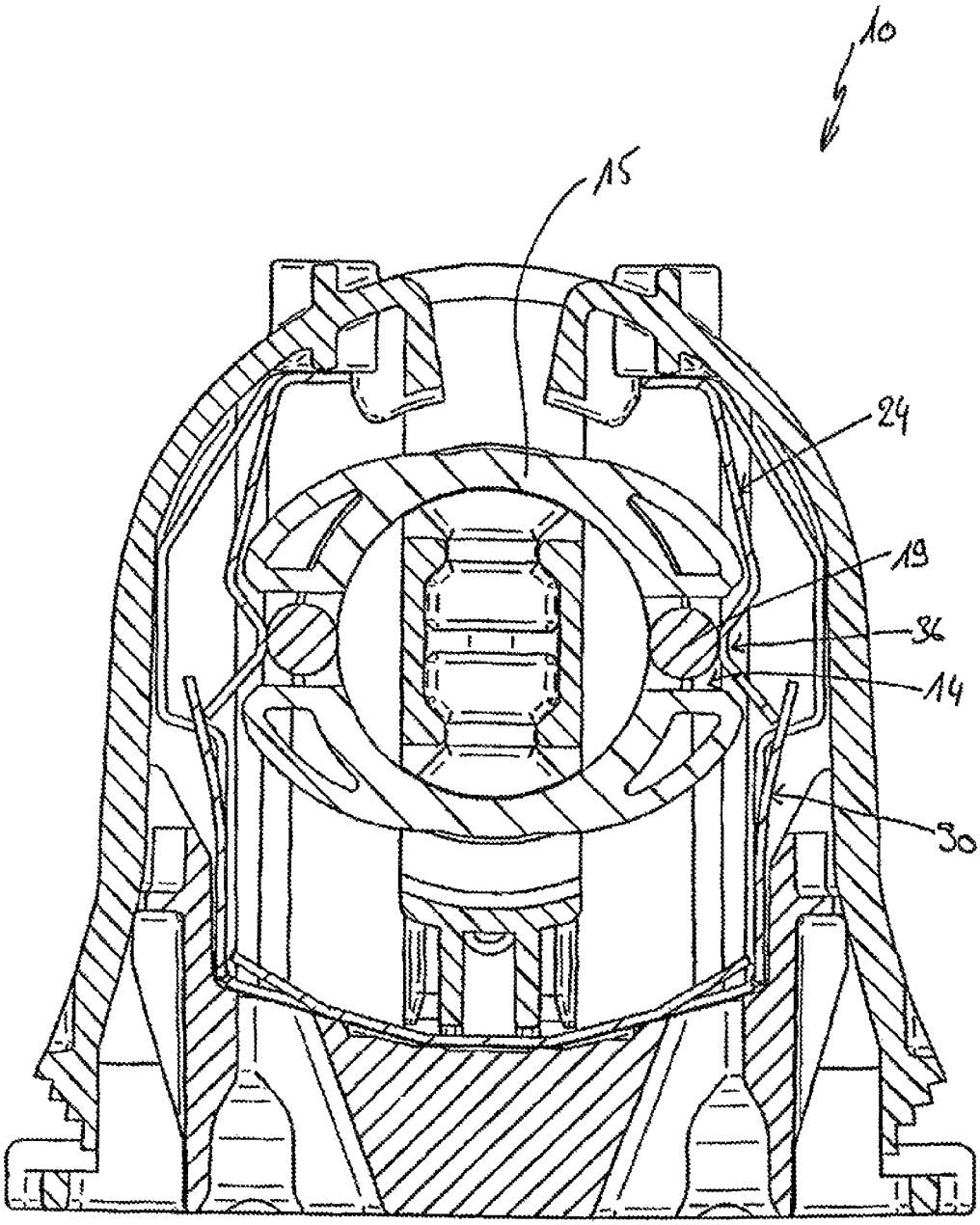
FIG. 8 is a longitudinal section according to FIG. 5 with the rotor in the contact position.

In the contact position shown in FIG. 8, that is, after completion of the 90° rotation of rotor 15, the contact edges 36 of the spring arms move into the installation slot 14 until they come to rest securely on the lamp pins 19 while the elastic spring arms 25 and 30 ensure a defined minimum contact force and a secure engagement of the contact edges 36 on the lamp pins 19.

Compensation is possible here within the framework of the occurring tolerances concerning the diameter and position of the lamp pins.

Figure 9:
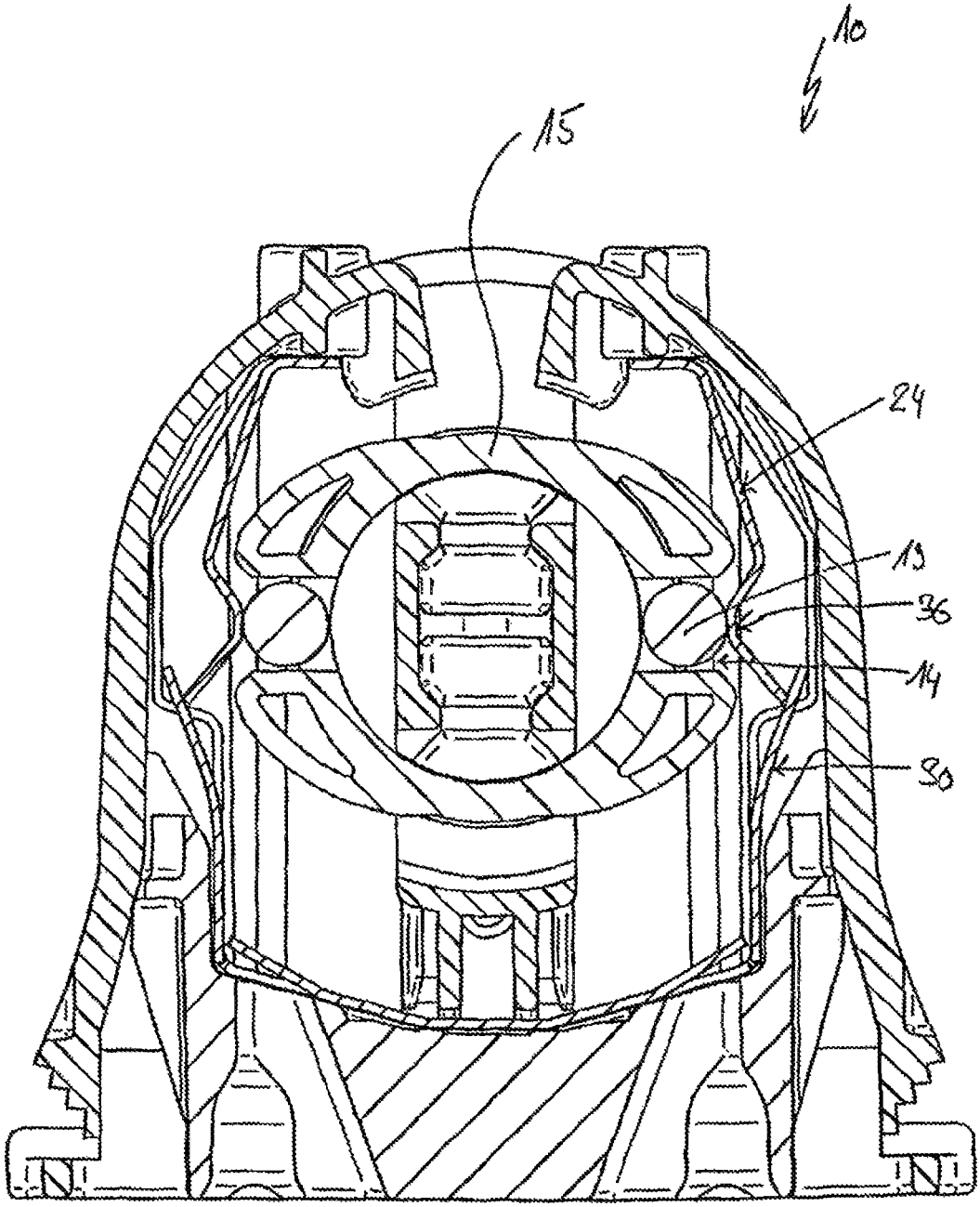
FIG. 9 is a longitudinal section like FIG. 8 with lamp pins of different size.

This is shown by comparing FIGS. 8 and 9, that also show a lamp holder 10 in longitudinal section with its rotor 15 in a contact position.

The lamp pins 19 in FIG. 9 have a larger diameter than those of FIG. 8 so that the contact edges 36 have to penetrate less far into the installation slots 14 in order to establish an electrical connection.

In the present embodiment the contact edges 36 taper conically toward the rotor center 20 and are designed flat at their apices; however, it is also conceivable that the contact edges 36 have a cup-shaped recess at their apices. The lamp pins 19 can rest or engage in these recesses, so that even the slightest rotational play of rotor 15 is reliably avoided in the contact position.

Alternatively or additionally, play-free engagement between the housing 11 and the rotor 15 can also be provided by appropriately adapted shapes of the housing part and/or of the rotor in the contact position, so as to eliminate a possible rotational play of the rotor 15.

It is furthermore essential that control protections 32 project from the outer surface of the rotor 15 in the area of the installation slots 14 in such a manner that they deflect the spring arm 24 in every other position than the contact position so far and in such a manner that contact between the spring arm 24 and the lamp pins 19 is excluded. Only the contact edges 38 are formed in such a manner tapering in the direction of rotor center 20 that the are able to penetrate into the installation slot 14 after passing the dead-center position of the rotor in order to rest on the socket contact pin 19.

Furthermore, the housing part in which the rotor 15 is supported has openings 40 at an axis running through the mouth 13 and slot 14. In order to simplify the mounting of the rotor 15 in housing 11, it can be inserted into the housing opening if the mouth 13 and installation slot 14 are aligned.

We claim:

1. In combination with a fluorescent lamp having an end provided with a pair of projecting, parallel, and spaced contact pins, a lamp holder comprising:

a housing formed with an outwardly open housing mouth;

a rotor rotatable in the housing adjacent the mouth about an axis and having a diametrally throughgoing rotor slot, the rotor being rotatable between an installation position with the rotor slot aligned with the mouth and an angularly offset contact position with the slot not aligned with the mouth, the rotor and housing being so dimensioned as to receive the pins extending parallel to the axis and to move the pins in a circular orbit centered on the axis on rotation of the rotor in the housing;

spring contacts in the housing diametrally flanking the axis and having contact parts angularly offset from the slot in the installation position of the rotor; and respective cam formations on the rotor engaging the contacts, holding the contact parts radially outside the orbit except in the contact and installation positions, and urging the rotor angularly into the contact and installation positions.

2. The combination defined in claim 1 wherein the formations are a respective pair of radially outwardly projecting bumps flanking each end of the slot and projecting radially outwardly past the orbit, whereby the bumps push the contact parts radially outward as the rotor turns in the housing between the installation position and the contact position.

3. The combination defined in claim 1 wherein the rotor is so dimensioned that when the pins are engaged in the slot they are recessed beneath the ends of the slot.

4. The combination defined in claim 1 wherein the contacts each also have a main part lying outside the orbit.

5. The combination defined in claim 4, the spring contacts are so constructed that the respective contact parts bear radially inward against the formations of the rotor while leaving the main parts of the contacts outside the orbit.

6. The combination defined in claim 5 wherein each contact part is formed as a narrow radially inwardly projecting edge fittable in the respective end of the slot.

7. The combination defined in claim 5 wherein the rotor has an outer surface of greatest diameter immediately adjacent each end of the mouth such that the rotor cams out the contact parts with the outer surface on rotation from the installation position to the contact position and in the contact position the contact parts snap into the slot ends and engage the pins.

8. The combination defined in claim 1 wherein each contact is formed by a single strip of elastically deformable conductive sheet metal forming the respective contact part and the respective main part.

9. The combination defined in claim 8 wherein each contact part is angularly substantially narrower than the slot, whereby the contact parts can fit freely into the slot.

10. The combination defined in claim 1 wherein the housing is formed with a seat receiving the rotor and provided with cutouts allowing the rotor to be fitted into and taken out of the housing only in the installation position.

11. In combination with a fluorescent lamp having an end provided with a pair of projecting, parallel, and spaced contact pins, a lamp holder comprising:

a housing formed with an outwardly open housing mouth;

a rotor rotatable in the housing adjacent the mouth about an axis and having a diametrally throughgoing rotor slot, the rotor being rotatable between an installation position with the rotor slot aligned with the mouth and an angularly offset contact position with the slot not aligned with the mouth, the rotor and housing being so dimensioned as to receive the pins extending parallel to the axis and to move the pins in a circular orbit centered on the axis on rotation of the rotor in the housing;

contacts in the housing diametrally flanking the axis; and formations on the rotor holding the contacts radially outside the orbit except in the contact position, the formations being a respective pair of radially outwardly projecting bumps flanking each end of the slot, whereby the bumps push the contact radially outward as the rotor turns in the housing from the installation position into the contact position, the bumps each having a steep flank on a side toward the respective slot end and a shallow flank on a side turned away from the respective slot end.

* * * * *